United States Patent [19]

Eberhardt

[11] 4,320,676

[45] Mar. 23, 1982

[54] BLANKING PRESS HAVING STRIPPING MEANS

[76] Inventor: Roland C. Eberhardt, 564 W. 39th St., San Pedro, Calif. 90731

[21] Appl. No.: 107,361

[22] Filed: Dec. 26, 1979

[51] Int. Cl.[3] ..... B21D 45/00

[52] U.S. Cl. ..... 83/146; 83/449; 83/520; 83/554; 83/563

[58] Field of Search ..... 83/146, 440.1, 449, 83/520, 554, 563, 566-580, 685-691

[56] References Cited

U.S. PATENT DOCUMENTS

| | | | |
|---|---|---|---|
| 608,725 | 8/1898 | Stark | 83/146 |
| 790,905 | 5/1905 | Laing | 83/146 |
| 2,502,072 | 3/1950 | Bender | 83/690 X |
| 2,588,087 | 3/1952 | Connor et al. | 83/520 X |
| 2,736,379 | 2/1956 | Winn et al. | 83/570 |
| 3,661,039 | 5/1972 | Lewis | 83/569 X |

*Primary Examiner*—James M. Meister

*Attorney, Agent, or Firm*—John Holtrichter, Jr.

[57] ABSTRACT

There is herein described a blanking press in which a punch is moved upwardly under pressure to engage a sheet workpiece and pass through a punch-conforming die plate aperture, the press housing including a product retrieving and operator-viewing opening in the upper end thereof to allow an operator to directly view the alignment of the workpiece relative to the die opening and the operation of the press by looking in a downward direction.

10 Claims, 5 Drawing Figures

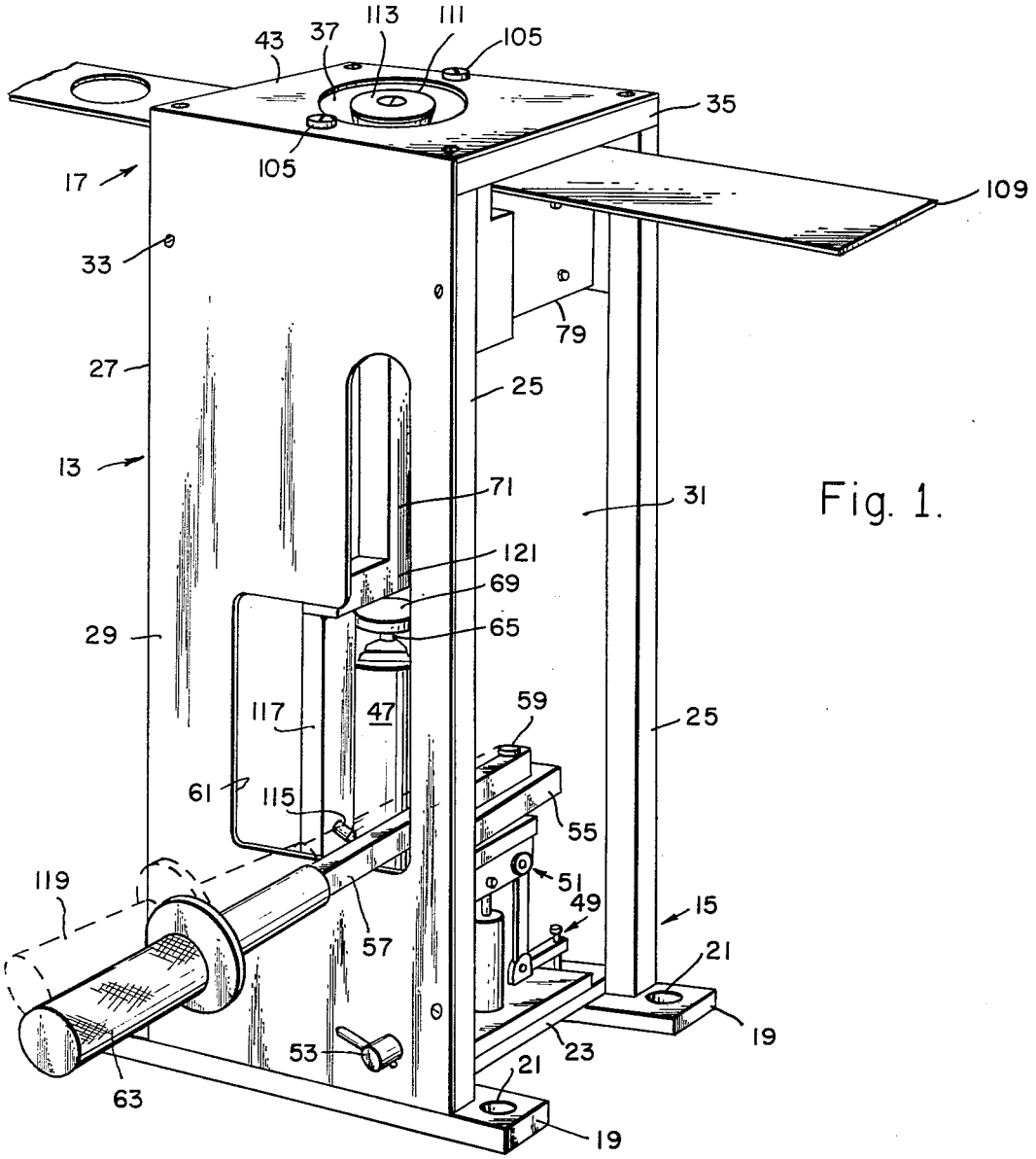
Fig. 1.
Fig. 3.
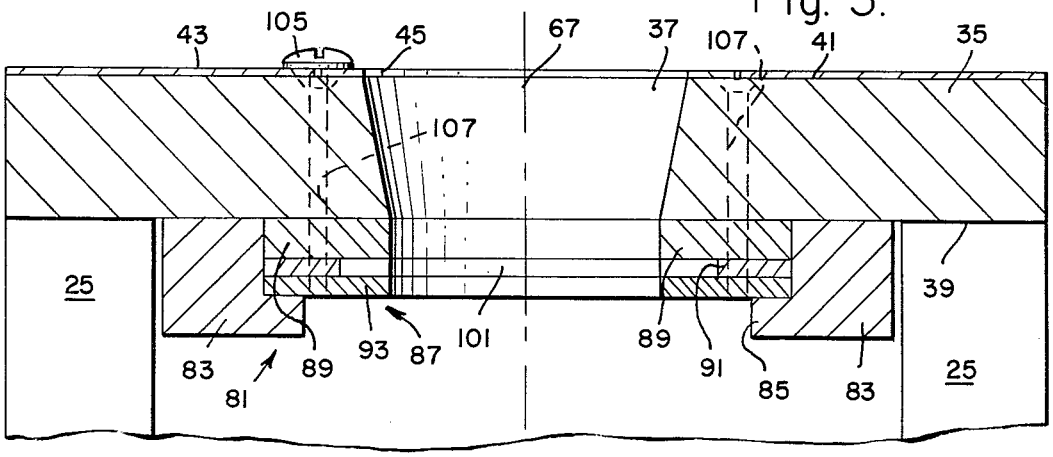

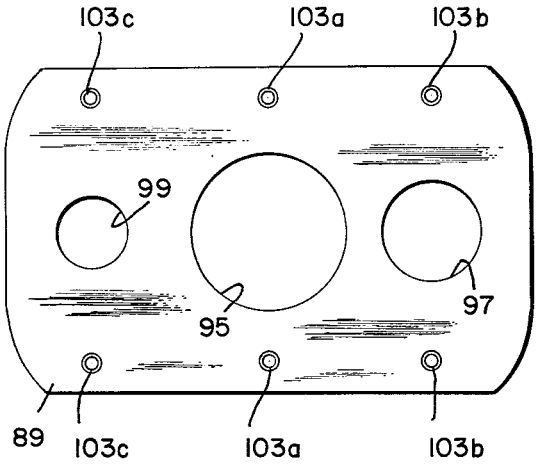
Fig. 5.
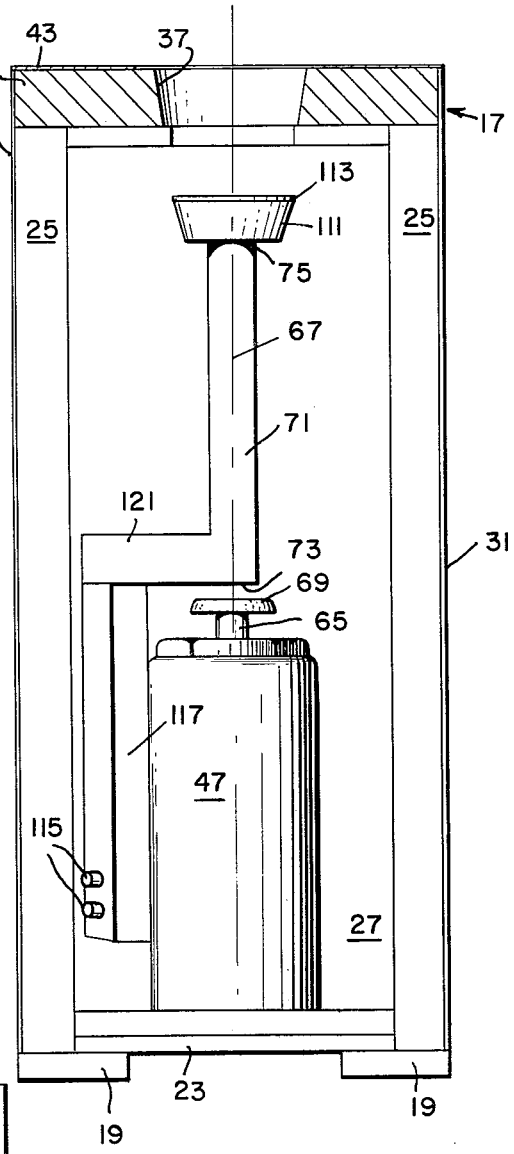
Fig. 2.
Fig. 4.
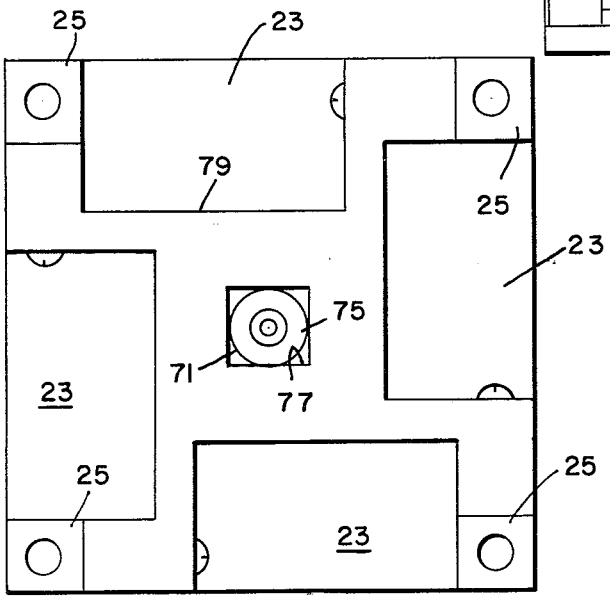

BLANKING PRESS HAVING STRIPPING MEANS

TECHNICAL FIELD

This invention relates to mechanical presses and more particularly to blanking presses used with sheet stock on which graphic art work is disposed.

BACKGROUND ART

Mechanical presses which punch metal plate have been in use for many years. In the trophy manufacturing business, for example, such presses produce insert discs for decorative plaque holders. Generally, these discs are round and the most commonly used sizes are $\frac{7}{8}$, $1\frac{1}{4}$ and 2 inches in diameter. Most of these insert discs are produced from lengths of thin sheet metal, such as aluminum, on which graphic art work is photo-etch engraved in series along the length of the strip. The art work pattern is generally round and slightly smaller in diameter than the disc size that is to be produced. The discs are then stamped out along the strip and then inserted into the decorative blank holder and held in place by a conventional adhesive material or process.

In this industry, for esthetic and safety reasons, it is important that the rough edge or "burr-side" that is caused by fracturing during the blanking operation be on the side of the sheet opposite that on which the art work resides. It is also important that the blank outside diameter be concentric, in the case of circular blanks, with the periphery of the circular engraved pattern, and that the engraved surface be free of scratches.

In the past, blanking operation has been accomplished by using conventional punch presses, the punch of which pierces the photoetched sheet in the conventional manner from the top, and passes down into a matching die located below the workpiece.

In order to produce the fracture burr on the side opposite the engraved or finished face side, the material is stamped with the engraved or face side down. A pilot system is normally used to try to blank the strip in the proper places. In this method, a first part is carefully blanked out as concentric with the design as possible by using mirrors or viewing from below, for example, and thereafter, each consecutive blank is processed by moving the strip an amount equal to the center-to-center distance between the successive individual art work designs.

The problem with this technique is that it requires much skill to obtain the first or pilot blank is exactly the right spot. Any error in centering here will be transmitted to all successive blanks. Also, this method requires that the design be exact progression on the strip, for if they vary, the blank outside diameter will no longer be concentric with the design. Further, by requiring that the art work be on the bottom of the strip being blanked, the design is often scratched as it slides along the die.

Still another method that is currently is use to accomplish this type of blanking operation is the use of a conventional punch press with a conventional die secured to the platen and having a prism or optical mirror positioned directly below the die opening, thus allowing the operator to see up into the die cavity in order to center the engraving concentrically within the die before tripping the press. Again, there is here the disadvantage of scratching the design because the art work is on the under side of the strip. In this configuration, the mirror often becomes soiled from parts dropping on it and from oil and grime adhering on the mirror's surface, so that it becomes increasingly more difficult to properly operate the machine. Further, the operator will not be able to look where her or his hands are, which creates an unsafe condition.

Three prior art press of which the inventor is aware are hereinafter described. U.S. Pat. No. 1,999,730 describes a blanking press which provides a blank of sheet material and thereafter draws or presses the blank into a desired hemispherical shape. The sheet material from which the blank is stamped is preferably previously printed in simulation of the iris and upper lid of a dolls eye. In this machine, as the upper die portion descends, the punch cuts a blank from a strip, and forces this blank against a forming post.

In U.S. Pat. No. 2,772,735, a single action multiple slide press having cooperative punching and cutting dies is shown. As the sliding head of the press is lowered, a centering ring engages an upper end of a neck portion of a preformed blank and centers it so that further downward movement of the head will move the blank telescopingly onto a cutting punch and into engagement with a punch supporting member.

Finally, U.S. Pat. No. 3,336,117 describes a two-member punch die which is used in the producton of finished expanded metal blanks. The upper die member or punch holder includes a body having a machined main cavity therein which slidably receives a spring-loaded cup forming punch and a cup wall crushing punch. The lower die has a body similarly provided with a main cavity in which a spring-loaded pad and stripper member is slidably disposed. The die members are mounted for movement in a conventional die press where the upper member is moved downwardly to cause a shearing action on a supply strip by cooperating cutting edges. Continued downward movement of the upper die member about the lower die member causes a sliding movement of a stripping member within a die cavity until the work-in-progress blank is pushed into a smaller diameter counter bore to form a cup or annular peripheral section on the blank about a forming head. At the end of the cycle, the punch holder is removed from about the die member and the finished blank is ejected by the return of the stripping member.

In all of the above-described presses, the punch portion of the press is moved downwardly, causing a shearing and/or forming process to occur. There is no facility in any of these machines for unobstructed visual observation by the machine operator of the actual work area in order to allow proper alignment of a design within the die perimeter. It should therefore be evident that a blanking press which allows the press operator to look down on the press to move a workstrip so that artwork designs may easily and accurately be centered with respect to the periphery of the die opening, would constitute a significant advancement in the art.

SUMMARY OF THE INVENTION

In view of the foregoing factors and conditions characteristic of the prior art, it is a primary object of the present invention to provide a new and improved blanking press.

Another object of the present invention is to provide a blanking press which allows an operator to view the work area by looking in a downward direction.

Still another object of the present invention is to provide a vertically-acting blanking press which includes an efficient means for retreiving a workproduct and reseting the press for its next cycle.

Yet another object of the present invention is to provide a relatively small but efficient blanking press which may be mechanically operated by one handle to both engage workpiece and quickly retrieve the workproduct.

Still a further object of the present invention is to provide an efficient blanking press which is easily adapted to change die sizes and shapes.

In accordancy with one embodiment of the invention, a blanking press includes a die member mounted in an upper portion of a housing having a base portion and an upper work-accepting portion. The die member includes a punch accepting aperture therein, and an elongated ram member with a punch mounted thereatop is axially movably mounted in the housing concentric with the die member aperture. The invention also includes a linear pressure exerting structure mounted in the housing below the ram member and has a vertically movable piston engagable with the ram member and coaxial therewith for exerting an upward force on the ram and punch members toward the aperture in the die member.

The upper portion of housing preferably includes an opening allowing an operator to directly view the punch-accepting aperture in the die member for ease of registration of a design imprinted on the workpiece and the die opening perimeter. Also, the press may include a pressure-exerting handle which both operates the pressure exerting structure and also pivots to rapidly move the ram member above the die member for removal of the finished product, and to a retracted position below the die member to clear the workpiece and allow it to be moved into position for another cycle.

The features of the invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a perspective view of a presently preferred embodiment of a blanking press in accordance with the present invention;

FIG. 2 is a side elevational view of the press shown in FIG. 1;

FIG. 3 is an enlarged section of the upper portion of the press of FIG. 1 as seen from the side;

FIG. 4 is a plan view of a gib frame used to guide the punch-supporting ram in the blanking press illustrated in FIG. 1; and FIG. 5 is a plan view of the die plate utilized in the embodiment of the invention shown in FIG. 1.

DETAILED DESCRIPTION OF THE INVENTION

Referring now to the drawings and more particularly to FIG. 1, there is shown a blanking press 11 including a housing 13 having a base portion 15 and an upper portion 17. The base portion includes base rails 19 with mounting holes 21, and the rails support a base plate 23. Also, mounted on the rails 19 are four vertical tie bars 25 to which side plates 27 and front and rear plates 29 and 31 are attached by any conventional means or fasteners such as screws 33, for example.

As shown in FIGS. 2 and 3, a top mounting plate 35 is attached, by screws for example, to the upper ends of the tie bars 25 to complete the housing structure. The mounting plate 35 includes an operator-viewing and finished product-retrieving opening 37 that preferably has a beveled surface such that the diameter at the lower surface 39 of the plate 35 is less than that of the upper surface 41. For asthetic purposes, a thin cover plate 43 may be secured to the upper surface 41 of the plate 43, and, of course, will include an opening 45 corresponding with the opening 37 in the top mounting plate.

In this embodiment of the invention, a hydraulic power jack 47 of conventional design is mounted on the base plate 23 and may be held in place by conventional attachment means such as bolts or b clamp assemblies such as indicated by reference numeral 49. The power jack depicted is of the type commonly used in automotive service applications and includes a lever assembly 51, a hydraulic valve control handle 53 and a pivot bar 55 attached to that portion of the lever assembly which normally carries a handle. To the pivot bar 55, an elongated handle 57 is attached by a pivot pin 59, the handle extending to the housing's exterior through an opening 61 in the front panel 29. For ease of use, a hand grip 63 is attached to the end of the handle 57.

The hydraulic power jack includes an elongated piston 65 having a vertically oriented longitudinal axis 67 and the piston supports a pivotal pressure pad 69 at the upper end thereof. The jack 47 is so positioned on the base 23 that the longitudinal axis 67 of the piston is coaxial with the center of the opening 37 in the top mounting plate 35.

Also in alignment with this axis is an elongated ram member 71 having a lower end 73 adjacent the jack's pivotal pressure pad 69, and having an upper end 75 extending through a bearing opening 77 in a gib frame 79 that is mounted in the upper portion of the housing 13 between the four vertical tie bars 25. Mounted between the gib frame 79 and the top mounting plate 35 is a die plate assembly tray arrangement 81 including L-shaped rails 83 each having a lip portion 85 for slidably supporting a die plate assembly, generally designated 87.

The die plate assembly 87 includes a die plate 89, spaced parallel spacer rails 91 and a stripper plate 93, as best seen in FIGS. 3 and 5. The die plate 89 is fabricated from tool steel and includes, in this embodiment, a large diameter opening 95, and mediam size opening 97 and a smaller size opening 99 (2", 1¼" & ⅞", for example).

The spacer rails 91 provide a stock insertion opening 101 between the die plate 89 and the stripper plate 93. The die plate assembly 87 is a layered or sandwich structure and the openings in the stripper plate 93 are slightly larger than and in registration with the die plate openings 95, 97 and 99, respectively. The assembly 87 further includes pairs of threaded holes 103*a, b & c*, each of which pairs are on a line that passes directly through the centerline of a different one of the respective die plate openings 95, 97 and 99. Thus, locating screws 105, as seen in FIGS. 1 and 3, pass through holes 107 on opposite sides of the opening 37 in the top mounting plate 35 and threadably engage one of the pairs of threaded holes 103 in the die plate assembly 87 to properly locate a desired die opening size below the viewing opening 37.

In operation, a blank size is first selected by moving the die plate assembly 87 to a location where a desired die opening registers with the viewing opening 37 in the top plate 35. Locating screws 105 are then threaded into the holes 103 to lock the assembly 186 fixidely in place. A length of flat stock material, such as an aluminum strip 109 is then placed into the opening 101 and moved to a position where a design imprinted on the strip is seen in the opening 37. The importance of having the die plate located at the uppermost portion of the press is to enable the operator to look directly down into the die opening in order to concentrically "target" the design on the strip within the die periphery. It should be understood that the width of the strip 109 should be less than the width dimension of the die assembly opening 101 so that the operator may utilize two degrees of freedom to properly position the stip.

With the ram 71 resting on the top of the pad 69 (the piston 65 of the jack being in its retracted position), and with an appropriately dimensioned and shaped punch 111 mounted by any conventional means such an a screw, for example, on top of the ram 71, the upper surface 113 of the punch will be located just below the lower surface of the workpiece 109, so that by simply raising and lowering the handle 57 in a first vertical plane once or twice, the punch will be forced through the stock to produce a blank.

The blank may then be rapidly raised up through the opening 37 for easy retrieval by simply swinging the handle 57 to the left to a position between two spaced pegs 115 extending from an elongated offset ejection actuation bar 117, as indicated by a dashed outline 119. In this ejection position, the handle is raised in a second vertical plane. This action raises the ejection actuation bar 117 which, in turn, raises the ram 71, through a transverse interconnection section 121. At its fully raised position, the handle will raise the upper surface 113 of the ram 111 to just above the level of the cover plate 43 where the blank may easily be removed.

The operator may now rotate the hydraulic valve handle 53 to its open or pressure relief position and move the handle 57 downwardly to lower the ram and the piston. The hydraulic valve is again turned to its closed position and the handle 57 moved back to the right, disengaging from the pins 115, to complete the cycle.

From the foregoing, it should be evident that there has herein been described a new and useful punch press in which (unlike a conventional punch press) a die plate is mounted in the upper portion of the press housing to enable the operator to look downwardly directly into the die opening to concentrically "target" a design carried on the upper surface of a workpiece within the die periphery. Also, it should be realized that the pivoting handle which blanks out the sheet stock in one operation and then is simply moved over and raised to eject the blank, constitutes a significant advancement in the art.

Although the presently preferred embodiment of the invention uses a conventional automotive type hydraulic jack as the power source, it should be understood that any hydraulic, pneumatic or other rectilinear exerting pressure source may be utilized. Also, a more complicated and adjustable gib mechanism which slidably guides the ram member may easily be devised by those skilled in this art. Further, the ram, transverse section and ejector bar may be separate members bolted or welded together, or these elements may be incorporated in a single cast member that is machined at bearing surfaces, for example. Preferably, the ejector bar is angled somewhat so that the pins 115 are orthogonal to the longitudinal axis of the handle 57 when the latter is moved between the pins.

Finally, it should be understood that although the present invention has been shown and described with reference to particular embodiments, it should be realized that various changes and modifications which are obvious to persons skilled in the art to which the invention pertains are deemed to lie within the spirit, scope and contemplation of the invention.

What is claimed is:

1. A blanking press, comprising:

a housing having a base portion and an upper work accepting portion;

a die member mounted in said upper portion, said die member including a punch accepting aperture therein;

an elongated ram member having a vertical longitudinal axis axially movably mounted in said housing, said ram including an offset vertically-extending ejection actuation member;

a punch member mounted at the upper end of said ram member; and linear pressure exerting means mounted in said housing below said ram member and having a vertically movable piston engageable with said ram member for exerting an upward force on said ram and punch members toward said aperture in said die member.

2. The blanking press according to claim 1, wherein said upper portion of said housing includes examining means for operator downward viewing of said punch accepting aperture in said die member.

3. The blanking press according to claim 1, wherein said housing includes workpiece accepting aperture immediately below the level of said die member.

4. The blanking press according to claim 1, wherein said linear pressure exerting means includes a pressure actuating handle extending outside said housing and being vertically reciprocally movable in a first vertical plane in a pressure exerting mode and being pivotally movable in a horizontal direction and thereby engageable with said ejection member and vertically movable in a second vertical plane.

5. The blanking press according to claim 4, wherein said ejection member includes a pair of spaced parallel pins extending toward said handle, said handle being pivotally movable to a position between said pins.

6. The blanking press according to claim 1, wherein said die member is the uppermost element of a die plate assembly that also includes a stripper plate parallel to and spaced from said die member by oppositely disposed spacer elements, the space between said die member and said stripper plate being adapted to accept a workpiece.

7. The blanking press according to claim 6, wherein said die member and said stripper plate include more than one set of corresponding openings of different dimensions.

8. The blanking press according to claim 6, wherein said die plate assembly is movable within said housing.

9. The blanking press according to claim 8, wherein said housing includes locking means to fix the position of said die plate assembly relative to said housing.

10. The blanking press according to claim 1, wherein said linear pressure exerting means is a hydraulic jack.

* * * * *